United States Patent [19]

Hirth

[11] 4,335,920

[45] Jun. 22, 1982

[54] HEADREST FOR A DENTAL CHAIR

[75] Inventor: Emil Hirth, Malsch, Fed. Rep. of Germany

[73] Assignee: Sybron Corporation, Rochester, N.Y.

[21] Appl. No.: 169,869

[22] Filed: Jul. 17, 1980

[30] Foreign Application Priority Data

Aug. 9, 1979 [DE] Fed. Rep. of Germany ..... 2932343

[51] Int. Cl.[3] ..... A61G 15/00; A47C 1/10

[52] U.S. Cl. ..... 297/408; 297/391; 297/409; 297/410

[58] Field of Search ..... 297/409, 408, 410, 406, 297/391

[56] References Cited

U.S. PATENT DOCUMENTS

| | | | |
|---|---|---|---|
| 520,577 | 5/1894 | Schwaab, Jr. | 297/408 |
| 1,505,474 | 8/1924 | Laraia | 297/408 |
| 2,466,553 | 4/1949 | McDonald, Jr. | 297/409 X |
| 2,740,467 | 4/1956 | Page | 297/409 |
| 2,740,467 | 4/1956 | Page | 297/409 |
| 3,477,761 | 11/1969 | Krantz | 297/409 |
| 3,603,642 | 9/1971 | Laessker | 297/408 |
| 3,936,091 | 2/1976 | Rabinowitz | 297/408 |
| 4,159,093 | 1/1979 | Hamilton | 297/409 X |
| 4,256,341 | 3/1981 | Goldner et al. | 297/408 X |

FOREIGN PATENT DOCUMENTS

| | | | |
|---|---|---|---|
| 2102543 | 8/1972 | Fed. Rep. of Germany . | |
| 2326255 | 3/1974 | Fed. Rep. of Germany . | |
| 2356982 | 5/1975 | Fed. Rep. of Germany | 297/408 |
| 2646613 | 4/1978 | Fed. Rep. of Germany . | |
| 2413236 | 8/1979 | France | 297/408 |
| 1439278 | 6/1976 | United Kingdom | 297/408 |

*Primary Examiner*—James T. McCall

*Attorney, Agent, or Firm*—Theodore B. Roessel; Roger Aceto

[57] ABSTRACT

An adjustable headrest for a dental chair having one lock for holding the headrest at an articulated position and a second lock for holding the headrest at an adjusted longitudinal position with respect to the backrest of the chair. The invention is a one hand operated lock release for operating both locks. The release can be constructed so that manipulation of a single member can accomplish sequential, independent or simultaneous operation of both locks.

11 Claims, 4 Drawing Figures

HEADREST FOR A DENTAL CHAIR

BACKGROUND OF THE INVENTION

The present invention relates generally to an adjustable headrest for a dental chair and more particularly to the means for moving the headrest to a selected position.

Generally, the headrest of a dental chair has a support which is journaled to one end of a tongue. The tongue, in turn, is slidably inserted into a slot in the backrest of the dental chair. This arrangement provides the headrest with two degrees of adjustment. In the first instant, the tongue can slide into and out of the headrest and in the second instant the headrest can be articulated about the tongue. Two locks are provided, one holding the tongue at its adjusted position with the respect to the backrest and the second for holding the headrest at its adjusted articulated position with respect to the tongue. Various releases are provided for manually unlocking and positioning the headrest at the desired adjusted position.

Typical of the prior art patents disclosing the degrees of motion of the headrest and various locking members are shown for example, in U.S. Pat. Nos. 2,740,467, 3,477,761, 3,603,642 and 3,936,091. Other patents illustrating different adjusting mechanisms and locks for adjustable dental chair headrests include German Pat. Nos. 23 26 255, 21 02 543 and 26 46 613.

According to the prior art, the problem to be solved by each of these patents, is the provision of a positive locking means which permits the adjustment of the tongue and the inclination of the headrest, the locks being relatively malfunction free, requiring a minimum of installation space and being quickly and easily unlocked to facilitate rapid adjustment of the headrest to any selected position.

SUMMARY OF THE INVENTION

The headrest according to the present invention is capable of being adjusted to any selected position between its limits of motion. This applies both to the articulation or swivel connection of the headrest to the tongue and the sliding position of the tongue relative to the backrest. Further, the locks as described herein are constructed so that the retaining power of the locking means automatically increases as the applied loading increases.

The headrest according to the invention can also be quickly and easily moved to any selected position for optimal support of the head of the patient with a minimum of fatigue or effort on the part of the dentist. In this respect, one advantage of the present invention is that both the tongue lock and the swivel or articulation lock can be released by operation of a single manually operated member wherein the release of both locks and repositioning of the headrest to the selected position can be accomplished with one hand.

DESCRIPTION OF THE PREFERRED EMBODIMENTS

Figures 1, 2, 3, 4:
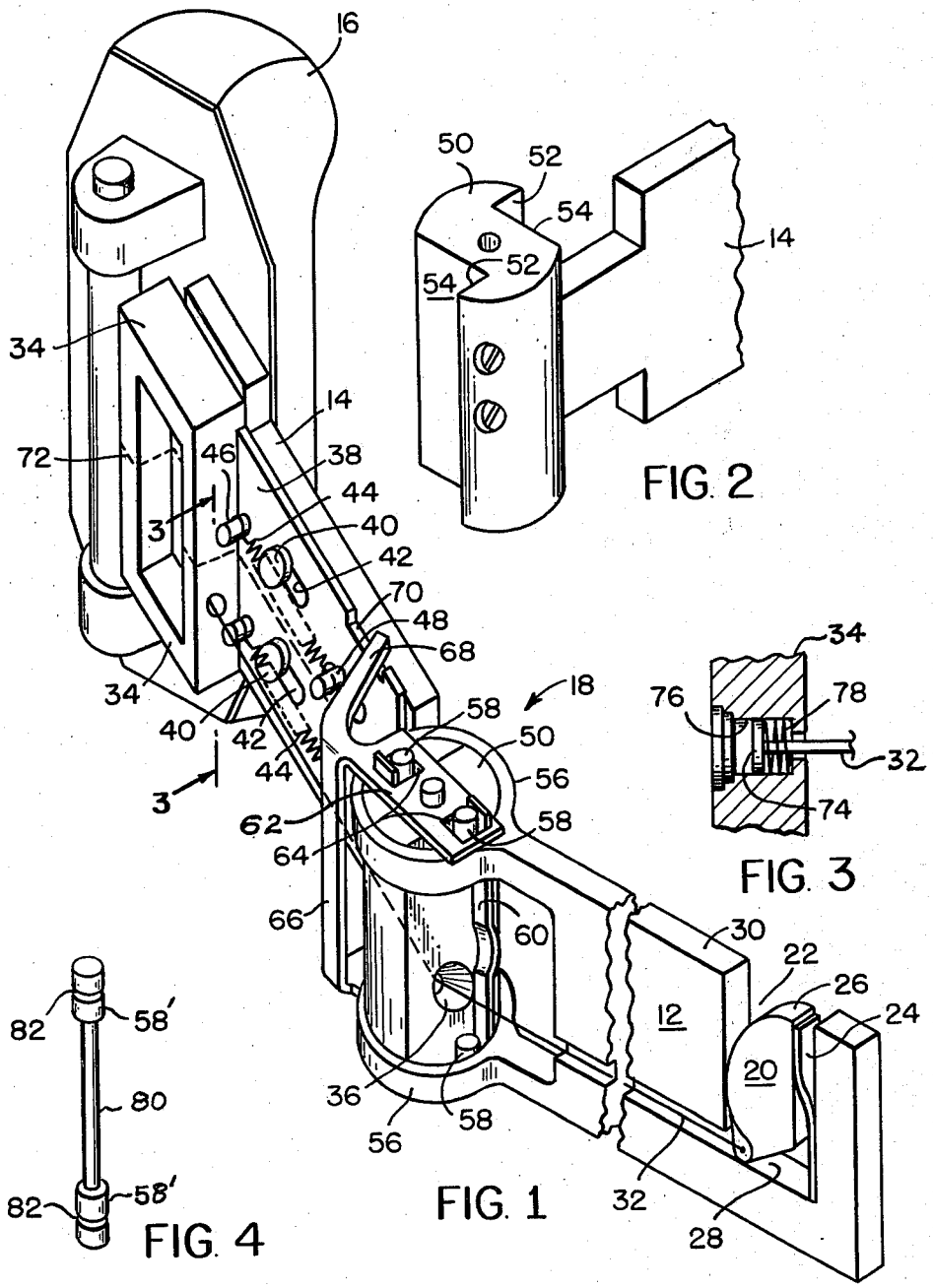
FIG. 1 is a perspective view of the dental headrest of the present invention.
FIG. 2 is a perspective view showing a portion of the journal of the headrest.
FIG. 3 is a view taken along lines 3—3 of FIG. 1.
FIG. 4 shows another embodiment of one element of the journal lock means.

Referring to the drawings, the headrest of the present invention includes a tongue 12 and a headrest support member 14. Support member 14 carries at one end, the upholstered surface 16 for cradling the head of the patient. The other end at support member 14 is connected to tongue 12 by a journal generally indicated at 18.

The tongue is constructed so that it can be inserted into an opening or slot in the upper end of the backrest of the dental chair (not shown). As is well known in the art, this opening would be similar to the tongue in cross-sectional shape and the length, so that the tongue could be inserted into the opening and longitudinally adjusted by sliding the tongue into or out of the opening.

Once adjusted in the longitudinal direction, the tongue is locked in position by a clamping member 20. This clamping member is carried in a cut out portion 22 located adjacent one end of the tongue. Clamping member 20 is urged in a counterclockwise direction by a spring 24 biased between the clamping member and one surface of the cut out portion.

The clamping member has a cam surface 26 so that this counterclockwise rotation of the member wedges the clamping member between a clamping surface 28 of the cut out portion and a surface of the backrest opening (not shown) which runs parallel with the side surface 30 of the tongue. This camming action shifts tongue 12 slightly sideways in the backrest opening so that the side of the tongue opposite side surface 30 is pressed against the corresponding side of the opening of the backrest. In this fashion the tongue is clamped or locked in its adjusted position.

The cam surface 26 of the clamping member is constructed so that a force applied to pull the tongue from the opening, rotates clamping member 20 clockwise thereby releasing its clamping action. Conversely, if a force is applied attempting to push the tongue farther into the backrest opening, the clamping member is moved in a counterclockwise or locking direction. Accordingly, an increase in force attempting to push the tongue into the backrest opening also increases the clamping force so as to maintain the tongue in its adjusted position.

For purposes of manually releasing the locking action of clamping member 20, a cable 32 is provided. This cable is connected at one end to the clamping member. It extends along a groove in the tongue, through journal 18 and has its other end connected to a lock operator 34. With this arrangement, a tug or pull on the operator pulls cable 32 so as to rotate clamping member clockwise against the bias of spring 24. As set out above, clockwise movement of clamping member 20 acts to disengage cam surface 26 from the corresponding side of the backrest slot to release the clamping action.

Since cable 32 passes through journal 18, care must be taken to prevent any tug or pulling on the cable as the journal rotates. To this end, the journal is provided with a funnel shaped opening 36 through which the cable passes. The wide end of the funnel faces in the direction of clamping member 20 and takes into account the arc length traveled by the journal as it rotates. This prevents the journal from engaging and pulling on the cable.

Operator 34 is in the form of a handle carried by a slide 38. Slide 38 in turn is slidably carried by headrest support member 14. In this respect, lugs 40 which are fixed to support member 14, extend through elongated slots 42 in the slide and slidably capture the slide to the support member. A pair of coil springs 44 extend between mounting pins 46 on the slide and pins 48 on the headrest holder 14. These springs act to bias the slide 38 toward journal 18. Pulling on operator 34 against the bias of springs 44 allows slide 38 to move relative to headrest support 14. This in turn pulls on cable 32 pulled thereby releasing clamping member 20.

Turning now to the construction of journal 18, FIGS. 1 and 2 show that the turning part or axle 50 of the journal has a pair of axially extending recesses at either side. Each recess is formed by the intersecting surfaces 52, 54 respectively. The headrest support 14 is attached to axle 50 by any suitable means such as the screws shown in FIG. 2.

Axle 50 is rotatably supported at its ends by a pair of spaced bearing 56 which are formed integral one end of tongue 12. The inner surface of each bearing 56, together with the recesses formed in the axle and in particularly the surfaces 54 of each recess, form the locking surfaces for the articulation lock as set out hereinbelow.

The articulation lock for journal 18 clamps the headrest in any adjusted articulated position and includes four roller members identified at 58. One roller 58 is disposed in each recess of the axle between the inner surface of the bearing and the surface 54 of the recess. A spring element 60 is biased between the second surface 52 of each recess and the roller 58. This spring urges the rollers to a locking position between the inner surface of bearing 56 and the recess surfaces 54 so as to prevent the axle from rotating.

In order to unlock the axle and permit readjustment of the headrest, each roller 58 is moved toward an associated surface 52 against the bias of spring 60. This is accomplished by a lever 62 which is pivotally attached to each end of axle 50. The lever has openings 64 through which the rollers extend. In addition, the levers 62 at each side of the axle are connected by a cross piece 66 which allows them to act in concert.

Each lever has an arm 68. These arms fit into notches 70 formed at each side of slide 38. With this arrangement movement of slide 38 away from the journal 18 by pulling lock operator 34 carries one end of the notch against lever arms 68 and rotates the levers 62 counterclockwise as viewed in the figure. Such rotation moves the rollers 58 against the bias of springs 60 to unlock the journal so that the headrest can be articulated or rotated relative to tongue 12 to a selected position.

Accordingly, simply by pulling the single lock operator 34 one can both unlock the clamping member 20 to permit longitudinal adjustment of the headrest and unlock the journal 18 to permit the articulation adjustment of the headrest. The headrest of the present invention, thus allows one hand operation wherein the release of both locks, the longitudinal adjustment and the articulation adjustment can be accomplished with one hand.

In order to prevent the simultaneous release of both locks, lock operator 34 and slide 38 can be longitudinally divided into two parts as shown by the dotted line identified at 72. By dividing lock operator 34 and slide 38 in this fashion, either side of the operator can be pulled separately to release clamping member 20 or the lock of journal 18 respectively. In the alternative, both halves can be pulled together to simultaneously operate both release mechanisms.

Where operator 34 and slide 38 is one-piece and not longitudinally split, an alternative structure permitting a sequential release of both locking mechanisms is illustrated in FIG. 3. The embodiment illustrated in FIG. 3 allows the release of the journal lock without releasing clamping member 20. This permits adjustment of the headrest to a desired articulated position without an unintended longitudinal adjustment of the headrest which otherwise could occur with simultaneous release of both clamping members.

According to the embodiment shown in FIG. 3, the end of cable 32 is attached to a piston 74. This piston is slidably retained in a counter bored opening 76 which extends partly through operator 34. This piston rests on a coil spring 78 which biases the piston away from the bottom portion of the bore. With this arrangement, pulling operator 34 to release the journal lock, causes coil spring 78 to collapse. This allows the operator 34 to move to some intermediate position with respect to the piston. Accordingly, when the operator moves to rotate levers 62, the cable is not pulled until the operator has moved passed its intermediate position so that piston 74 engages the bottom of bore 76. Thereafter, further pulling on the operator will pull the cable to release cam lock 20. Thus, this arrangement also allows selective or sequential operation. That is a slight pull on the operator will operate to release only the journal lock whereas a larger pull will operate to release both the journal lock and clamping member 20.

Rollers 58, which provide the locking mechanism for the journal, are shown in FIG. 1 as being independent. However, it is also possible to tie the two rollers together to form one piece as shown, for example, in FIG. 4. In FIG. 4, the two rollers 58' are connected to the ends of a shaft 80. This arrangement improves axial positioning of the rods 58' within the journal. In this respect, any axial motion may be prevented by providing the journal with a retaining ring (not shown) which engages circumferential grooves 82 formed in the rods.

Thus, it should be apparent that the present invention provides a headrest which can be easily and conveniently adjusted with one hand. For example, using an end surface of the headrest as a thumb support and gripping the lock operator 34 with the fingers of the same hand, a pull on the lock operator will unlock both clamping member 20 and the lock for journal 18. Using the same hand, the operator can then push or pull the headrest longitudinally and/or articulate the headrest about journal 18 to a desired position. Releasing the grip on the headrest and lock operator 34 will automatically lock the headrest in this adjusted position.

Having thus described the invention in detail, what is claimed as new is:

1. In an adjustable headrest for dental chairs including a tongue adapted for sliding insertion into the backrest of a dental chair, a headrest support journaled to the tongue, a first lock at the journal of the headrest support to the tongue for holding the headrest support at a selected articulated position with respect to the tongue and a second lock between the tongue and backrest for holding the tongue at a selected position relative to the backrest, the improvement comprising:

(a) an operator movably mounted to the headrest support, said operator being manually movable with respect to the headrest support from a first to a second position;

(b) means biasing said operator towards said first position;

(c) spring elements urging each of the first and second locks to a locked position;

(d) a cable operated release for one of the locks, the cable of said release having one end connected to said operator;

(e) a lever operated release for the other of said locks, said lever operated release having a lever arm rotated by said operator; and (f) said cable being pulled and said lever arm being rotated upon movement of said operator to said second position for releasing both the first and second locks.

2. In an adjustable headrest for dental chairs including a tongue adapted for sliding insertion into the backrest of a dental chair, a headrest support journaled to the tongue, a first lock at the journal of the headrest support to the tongue for holding the headrest support at a selected articulated position with respect to the tongue and a second lock between the tongue and backrest for holding the tongue at a selected position relative to the backrest, the improvement comprising:

(a) an operator movably mounted to the headrest support, said operator being manually movable with respect to said headrest support between a first and a second position; and (b) connector means extending between and operatively connected to said operator and to each of said first and second locks, said means being adapted to release first lock upon movement of said operator to a position intermediate the first and second positions and said means being adapted to release both the first and the second locks when said operator moves to said second position.

3. A headrest as in claim 2 wherein said operator is slidably mounted to said headrest support.

4. A headrest as in claim 3 wherein said operator has a slot at one side adapted to receive said lever arm, the sliding movement of said operator causing an edge of said slot to engage and rotate said lever arm.

5. A headrest as in claim 2 wherein:

(a) said lever operated release is associated with said first lock;

(b) said operator has a slot at each side; and (c) said lever operated release has a lever arm at each axial end of said journal, each lever arm being received into a corresponding one of said slots.

6. A headrest as in claim 5 including a cross piece extending between and connecting said lever arms to insure operation of said lever arms in concert.

7. A headrest as in claim 2 wherein said cable operated release is associated with said second lock to permit sliding adjustment of the tongue with respect to the backrest, the cable of said cable operated release passing through the journal connecting the headrest support to the tongue and said journal having a generally funnel shaped passage therethrough to accommodate the passage of said cable, the wider opening of said passage facing in the direction of said second lock.

8. An adjustable headrest as in claim 2 including means associated with said operator permitting sequential release of said first and second locks.

9. An adjustable headrest as in claim 8 wherein said means permitting sequential release of said locks is constructed so as to permit first the operation of said cable operated release and then the operation of said lever operated release responsive to the progressive movement of said operator towards said second position.

10. An adjustable headrest as in claim 9 wherein said means permitting sequential release of said locks comprises:

(a) said operator having a counter bored opening therein;

(b) a piston slidably disposed in said counter bore, one end of the cable of said cable operated release being fixed to said piston;

(c) bias means in said counter bored opening acting on said piston to permit said operator to travel with respect to said piston, to a position intermediate the first and second position of said operator, said piston not moving and said cable operated release not operating until said operator; and (d) the lever arm of said lever operated release being arranged so that it is rotated by said operator upon movement of said operator towards said intermediate position.

11. A headrest as in claim 2 wherein;

(a) said operator has two side-by-side sections, each section being movable to said second position independent of the other;

(b) one of said sections being connected to said cable operated release and a second of said sections having a portion to engage and rotate said lever operated release; and (c) said side-by-side sections being adapted for selected simultaneous or independent manual manipulation so as to simultaneously or independently release the first and second locks.

* * * * *